US005991970A

United States Patent [19]

Jailor et al.

[11] Patent Number: 5,991,970

[45] Date of Patent: Nov. 30, 1999

[54] UPRIGHT VACUUM CLEANER WITH POWER SWITCH PEDAL

[75] Inventors: John J. Jailor, Rockford; Steven K. Meek; Jeffrey A. Hall, both of Grand Rapids, all of Mich.; Scott R. Graham, Kewaskum; William H. Frederick, West Bend, both of Wis.

[73] Assignee: BISSELL Homecare, Inc., Grand Rapids, Mich.

[21] Appl. No.: 09/010,314

[22] Filed: Jan. 21, 1998

Related U.S. Application Data

[60] Provisional application No. 60/035,870, Jan. 22, 1997.

[51] Int. Cl.[6] ..... A47L 9/28

[52] U.S. Cl. ..... 15/339; 15/351; 15/412

[58] Field of Search ..... 15/339, 412, 351

[56] References Cited

U.S. PATENT DOCUMENTS

| | | | |
|---|---|---|---|
| 2,688,671 | 9/1954 | Segesman | 200/61.58 |
| 3,170,184 | 2/1965 | Jepson et al. | 15/323 |
| 3,766,594 | 10/1973 | Westergren et al. | 15/339 X |
| 4,748,713 | 6/1988 | Sepke et al. | 15/351 |
| 5,383,252 | 1/1995 | Hampton et al. | 15/325 X |
| 5,765,258 | 6/1998 | Melito et al. | 15/412 X |

*Primary Examiner*—Chris K. Moore

*Attorney, Agent, or Firm*—Rader, Fishman, Grauer & Mc Garry

[57] ABSTRACT

A vacuum cleaner comprises a housing, a motor mounted in the housing, and a switch coupled the motor for actuating the motor to an operative and an inoperative condition. The switch includes an actuator button for moving the switch between an opened and a closed position. A foot pedal is pivotally mounted to the housing and has a bottom surface in an abutting relationship with respect to the actuator button. The foot pedal can include an axle having a pair of flat surfaces which pivotally mount to a slotted circular retainer in the housing. The bottom surface of the foot pedal can include a depending flange which is in abutting relationship with the actuator button. Further, a spring can be disposed between the bottom surface of the foot pedal and the housing to bias the foot pedal away from the switch wherein the spring at least partially surrounds a portion of the foot pedal and at least partially surrounds the actuator button.

19 Claims, 8 Drawing Sheets

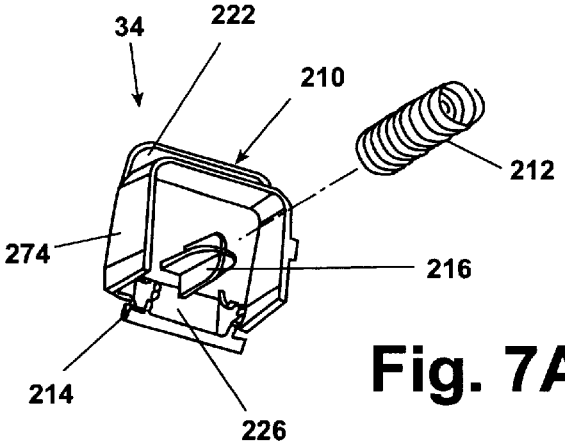
Fig. 7A
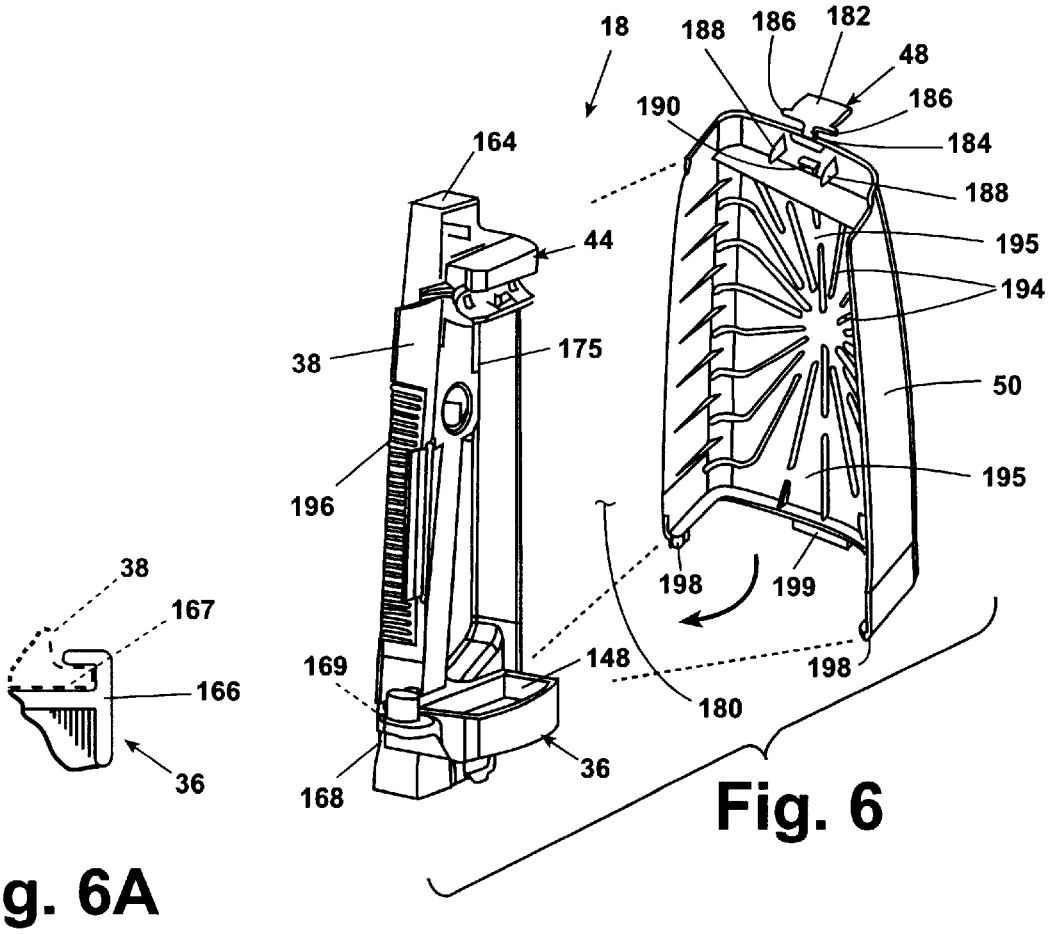
Fig. 6
Fig. 6A

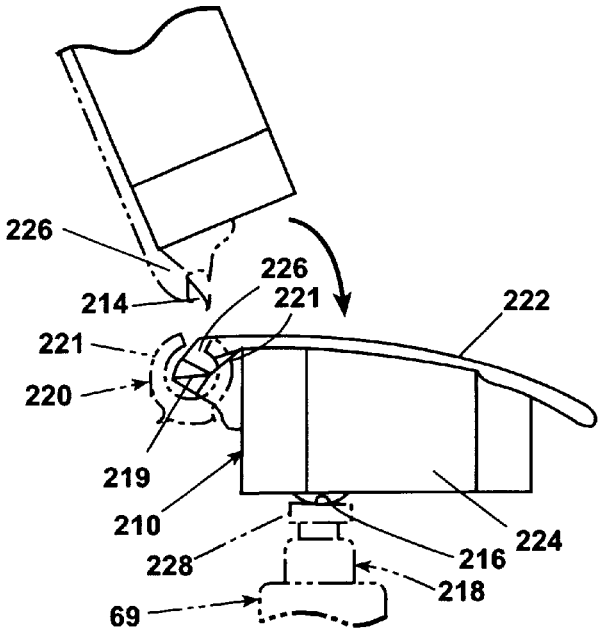
Fig. 7B
Fig. 7C
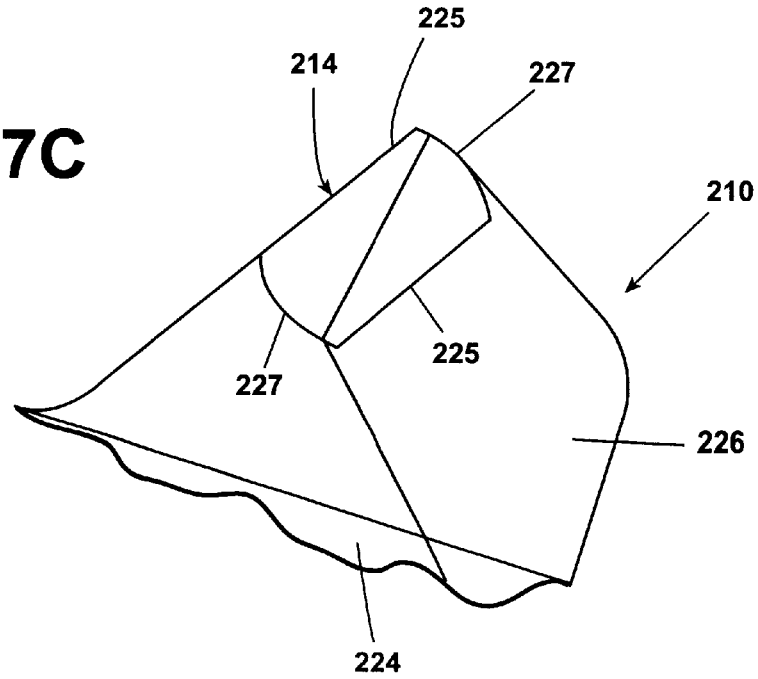

UPRIGHT VACUUM CLEANER WITH POWER SWITCH PEDAL

CROSS REFERENCE TO RELATED APPLICATION

This application claims the benefit of U.S. Provisional application No. 60/035,870, filed Jan. 22, 1997.

BACKGROUND OF THE INVENTION

1. Field of the Invention

The invention relates generally to upright vacuum cleaners, and, more specifically, to upright vacuum cleaners having a foot-actuated power switch pedal.

2. Description of the Related Art

For convenience, upright vacuum cleaners are often provided with a toggle switch interconnected with a vacuum motor. A user can activate the vacuum motor by momentarily depressing the toggle switch to perform a cleaning operation. When the cleaning operation is completed, the user can again momentarily depress the toggle switch to deactivate the vacuum motor.

It is important to protect the toggle switch of the vacuum motor to prevent damage thereto—usually by the foot of the user during actuation. Accordingly, the toggle switch is typically provided with a movable cover mounted over the toggle switch, which provides an engagement area for the user to depress. Thus, direct contact with the toggle switch is avoided. Examples of vacuum cleaners provided with a movable cover mounted over a toggle switch for actuating the vacuum motor thereon are shown in U.S. Pat. No. 5,383,252 to Hampton et al. issued Jan. 24, 1995, U.S. Pat. No. 2,688,671 to Segesman issued Sep. 7, 1954, and U.S. Pat. No. 3,170,184 to Jepson et al. issued Feb. 23, 1965.

Often, these types of covers require fastening to the vacuum with a conventional threaded fastener. Further, these types of covers also increase the costs associated with manufacturing and assembling the vacuum cleaner by the incorporation of these fasteners and by often requiring that a particular movable cover be specially-configured to be used with a particular toggle switch for a vacuum motor.

SUMMARY OF THE INVENTION

The invention relates to a vacuum cleaner comprising a housing, a motor mounted in the housing, and a switch coupled the motor for actuating the motor to an operative and an inoperative condition. The switch includes an actuator button for moving the switch between an opened and a closed position. A foot pedal is preferably pivotally mounted to the housing and has a bottom surface in an abutting relationship with respect to the actuator button.

In one aspect, the foot pedal includes an axle having a pair of flat surfaces and the housing has a slotted circular retainer including a gap between a pair of arcuate arms for rotatably retaining the axle and the axle flat surfaces are adapted to fit through the gap for mounting the axle to the circular retainer.

In another aspect, the bottom surface of the foot pedal includes a depending flange in abutting relationship with the actuator button.

In a further aspect, a spring is disposed between the bottom surface of the foot pedal and the housing to bias the foot pedal away from the switch which at least partially surrounds a portion of the foot pedal and at least partially surrounds the actuator button.

The axle of the foot pedal preferably further comprises a pair of arcuate surfaces joining the flat surfaces and journals the axle within the slotted circular retainer. The bottom surface of the foot pedal can include a depending flange in abutting relationship with the actuator button. The depending flange of the foot pedal can be x-shaped. A spring can be disposed between the bottom surface of the foot pedal and the housing to bias the foot pedal away from the switch. The spring can at least partially surround the depending flange. The spring can also at least partially surround the actuator button. In addition, the flat surfaces of the axle can be substantially parallel to one another.

BRIEF DESCRIPTION OF THE DRAWINGS

The invention will now be described with reference to the drawings wherein:

FIG. 6 is a perspective exploded view of the bag housing of the upright vacuum cleaner of FIGS. 1–5, showing the interior of the bag housing and assembly thereof;

FIG. 6A is a fragmentary cross-sectional view of the vacuum cleaner of FIGS. 1–6, taken along lines 6A—6A of FIG. 4;

FIG. 7A is a perspective view of a power switch pedal and spring used in the upright vacuum cleaner of FIGS. 1–6;

FIG. 7B is a side elevational view of the power switch pedal of FIG. 7A shown mounted to a lower portion of the vacuum cleaner of FIG. 2 in a first position (phantom outline) showing the insertion of the power switch pedal into a mounting socket of the vacuum cleaner and a second position (solid line) showing the normal use position of the power switch pedal;

FIG. 7C is an enlarged side elevational view of a mounting protrusion provided on the power switch pedal of FIGS. 7A and 7B;

DESCRIPTION OF THE PREFERRED EMBODIMENTS

Figure 1:
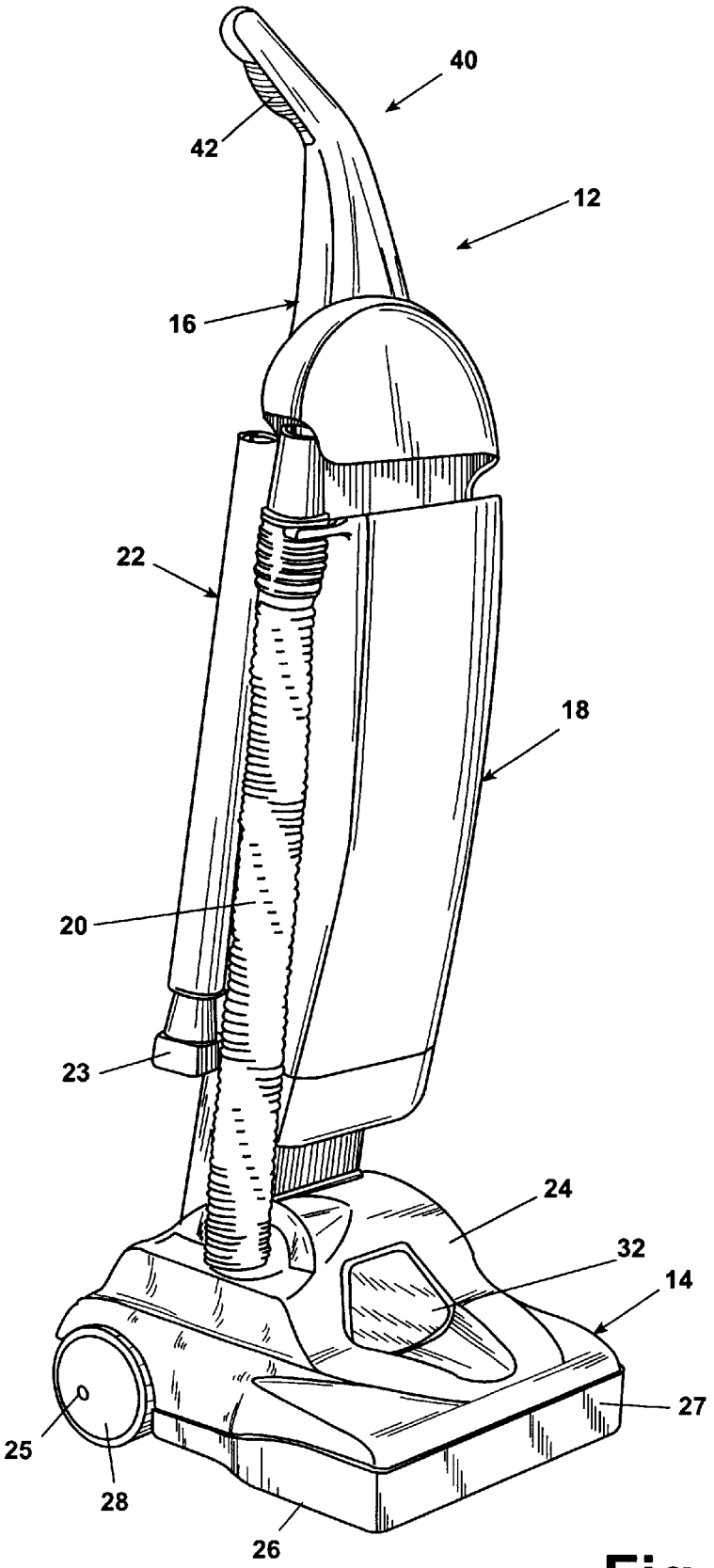
FIG. 1 is a front perspective view of an upright vacuum cleaner according to the invention.

Referring now to the drawings and to FIGS. 1–4 in particular, an upright vacuum cleaner 12 according to the invention is shown. The vacuum cleaner 12 comprises a floor engaging foot 14, a handle assembly 16 pivotally mounted to and extending upwardly from the foot 14, a bag housing 18 provided on the handle assembly 16 and a flexible hose 20 extending upwardly from the foot 14. A rigid accessory wand 22 is provided on a support member 23 formed on the handle assembly 16. The wand 22 can be removed from the support member 23 and connected to the flexible hose 20 for above-the-floor cleaning operations.

Alternatively, the foot 14 can be pushed along the floor for traditional on-the-floor cleaning.

Figure 4:
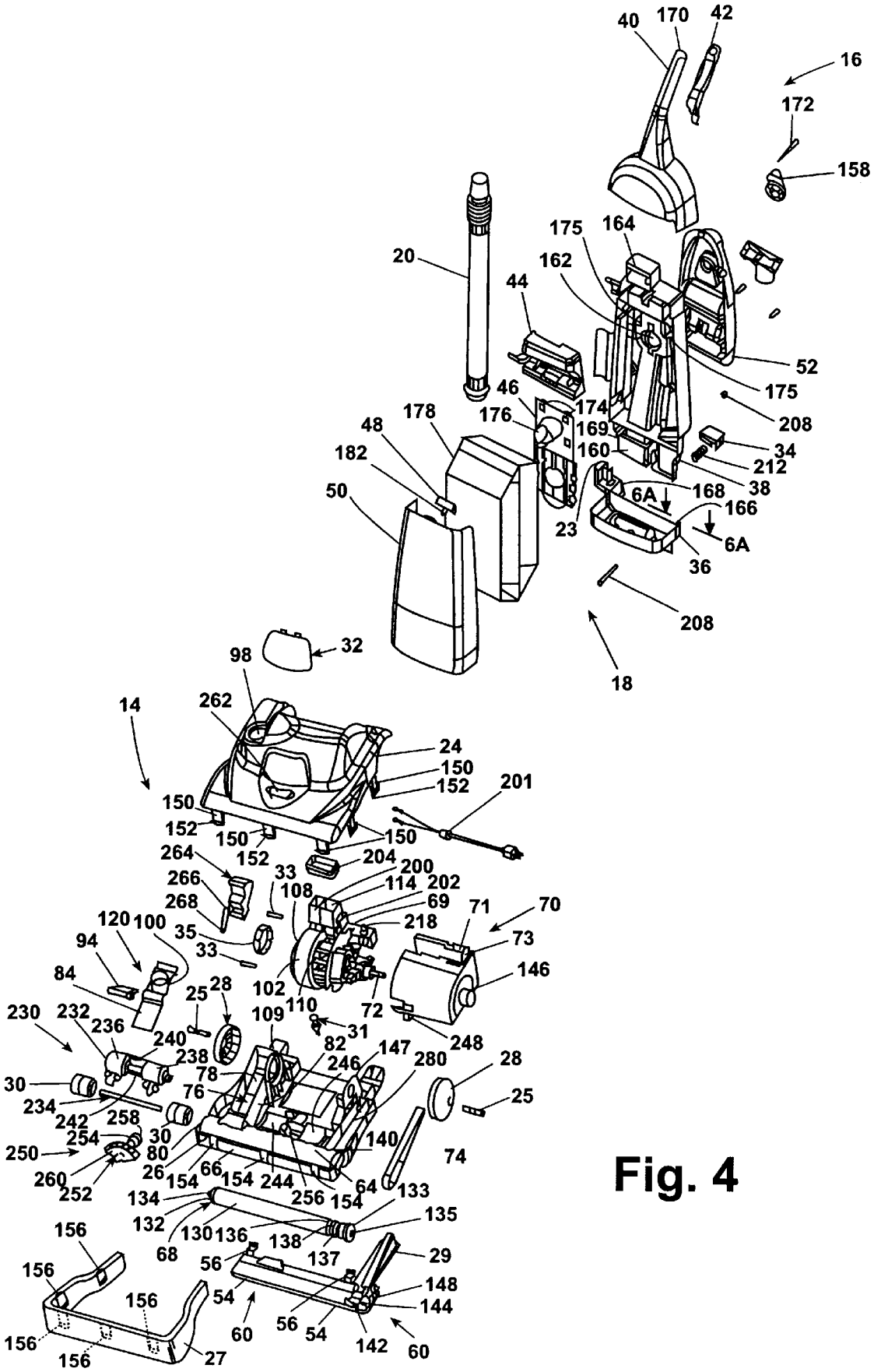
FIG. 4 is an exploded view of the upright vacuum cleaner of FIG. 1.
Figure 9:
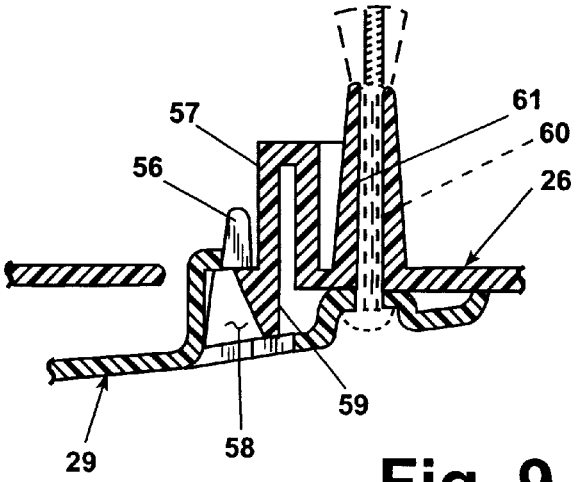
FIG. 9 is a fragmentary cross-sectional view of the vacuum cleaner of FIGS. 1–6, taken along lines 9–9 of FIG. 3.

The foot 14 comprises a cover 24 which is mounted to a base pan 26, a pair of rear wheels 28 supported by pins 25 are provided on the base pan 26 for rollably supporting the rear of the vacuum cleaner 12 and a pair of lift wheels 30 are provided at a central portion of the base pan 26 and adapted to lift the front of the foot 14 away from the floor when the handle 16 is moved to an upright position to prevent a rotating brush roll 68 from damaging the carpet and to provide a mechanism for manually adjusting the operating height of the brush roll 68. The base pan 26 includes a bumper 27 molded to the outside of the base pan 26 and a sole plate 29 mounted to the underside thereto. The sole plate 29 comprises an apertured base for retaining the brush roll 68 in the base pan 26 and a rearwardly-extending flange which serves as a cover for vacuum motor drive belt 74. The sole plate 29 is mounted to the base pan 26 by forward projections 54 on the sole plate 29 and corresponding slots (not shown) in the base pan 26. As shown in FIG. 4 and in greater detail in FIG. 9, a flexible finger 56 extends upwardly from each lateral side of the sole plate 29 and is releasably received in a slot 58 and lockingly engages a downwardly-extending tab 57 having a rearwardly-extending flange 59 in the base pan 26. Each flexible finger 56 can be removed from engagement with the tab 57 by either inserting a user's finger or a tool such as a screwdriver into the slot 58 and urging the flexible finger 56 forwardly and the tab 57 rearwardly. This action causes the flange 59 on the tab 57 to be released from engagement with the flexible finger 56 for removal of the sole plate 29 from the base pan 26. Alternately, or in addition to the flexible finger 56, screws 60 received within sockets 61 can be used to secure the sole plate 29 to the base pan 26. The sole plate 29 further has a rectangular flange 148 projecting upwardly from one side of the front portion thereof.

The cover 24 and the base pan 26 are both made of injection-molded resilient plastic. The bumper 27 is made of an elastomeric material that adheres to the base pan 26 and the bond is enhanced by dado-type undercuts in each part which provide additional mechanical holding. As shown in FIGS. 4 and 6, the cover 24 has a lower edge 62 which abuts an upper edge 63 of the base pan 26. The cover 24 further has a number of depending tabs 150 which extend along the front and sides of the cover 24. The tabs 150 have a lateral flange 152. The tabs 150 fit within a recess 154 formed in the base pan 26 and the lateral flanges 152 of the tabs 150 fit within an indentation 156 in the elastomeric bumper 27. The base pan 26 is formed by an injection-molding process in which the recesses 154 are formed. The bumper 27 is then overmolded to the base pan 26 in a mold which includes a core positioned within the recess 154 provided with a flange which corresponds to the lateral flange 152 on the cover tab 150. After overmolding, the core is pulled out of the recess 154. The elastomeric bumper 27 yields to permit the flange of the core to be pulled through the recess 24 which permits the depending tabs 150 on the cover 24 to retain the bumper 27 against the base pan 26.

A conventional light 31 and lens 32 are provided on the front of the cover 24 for illuminating the area in front of the foot 14. The lens 32 includes a progressive series of Fresnel elements (not shown) on an interior surface to direct the emission from the light 31 toward the floor (not shown) in front of the vacuum cleaner 12.

Referring to FIG. 4, the handle assembly 16 comprises a handle base 36, a fill tube 38, a handle 40, a handle grip 42, a latch receptacle 44, a bag retainer 46, a latch handle 48, an access panel 50 and an attachment 52 which includes storage compartments for vacuum cleaner tools and a rearwardly-extending wrapping loop 158 for an electrical cord 201. The fill tube 38 comprises a rear housing portion 86 including a vertical conduit 88 beginning at an inlet port 160 and terminating at a laterally-extending outlet port 162. The fill tube 38 further includes a vertically-extending flange 164. As shown in FIGS. 6 and 6A, the handle base 36 includes upstanding walls 148 and a pair of rails 166 and 168 adapted to slidably receive flanges 167 and 169, respectively, on the fill tube 38 around the inlet port 160. Likewise, the latch receptacle 44 includes rails (not shown) through which the latch receptacle 44 is slidably attached to the upper portion of the fill tube 38. The bag retainer 46 includes several rearwardly-extending tabs 174 which snap-fit adjacent the outlet port 162 of the fill tube 38 and includes a forwardly extending bag flange 176 for mounting a conventional filter bag 178 within a chamber 180 formed by the interior surfaces of the handle base 36, fill tube 38, latch receptacle 44 and the access panel 50.

The handle 40 includes an upper cylindrically-shaped flange which mounts the handle grip 42 and is shaped to ergonomically and comfortably receive a user's hand for pushing the vacuum cleaner 12 during use. The base of the handle 40 includes an axial chamber 90 which receives the vertical flange 164 on the fill tube 38 to mount the handle 40. An aperture in the wrapping loop 158 is aligned with corresponding apertures in the attachment 52, handle 40 and fill tube 38. A single screw 172 is inserted into the aligned apertures and threaded into a socket 175 in the latch receptacle 44 mounted to the fill tube 38 to secure the handle 40 between the attachment 52 and the fill tube 38 and to secure the latch receptacle 44 to the fill tube 38.

As shown in the exploded view of FIG. 4 and in greater detail in FIG. 6, the above-described bag chamber 180 is adapted to support the conventional filter bag 178 which receives the dirt and debris picked up by the vacuum motor. The access panel 50 is provided on the front of the bag housing 18 which can be removed or pivotally opened relative to the bag housing 18 to provide access to the bag chamber 180 for changing the filter bag 178. The access panel 50 mounts the latch handle 48 which includes a pair of L-shaped flanges 182 with an integral spring 184 therebetween and lateral protrusions 186 at each end of the flanges 182. The lateral protrusions 186 on the latch handle 48 are pivotally received in loops 188 near the top edge of access panel 50 to rotatably mount the latch handle 48 to the access panel 50. The integral spring 184 comprises a resilient arm which extends rearwardly from the L-shaped flanges 182 and bears against a shelf 190 on the access panel 50 beneath the loops 188 to outwardly bias the latch handle 48. The access panel 50 has a pair of depending tabs 198 at the lower sides and a depending tab 199 at a front side which fit behind the upstanding walls 148 to retain the lower portion of the access panel 50 on the handle base 36. To latch the access panel 50 to the fill tube 38, the access panel 50 is rotated on the depending tabs 199 and the outer legs of the flanges 182 hook behind a pair of catch fingers 192 on the latch receptacle 44 mounted to the fill tube 38 against the bias of the integral spring 184 on the latch handle 48.

As seen in FIG. 6, access panel 50 has several radial ribs 194 extending outwardly from the center of the interior of the access panel 50. The ribs 194 are designed to suspend a convention filter bag 178 a short distance from the interior surface of access panel 50 to prevent the filter bag 178 from sealing to the interior surface of the housing during use. In addition, the ribs 194 include several slot portions 195 designed to channel air flow between the filter bag 178 and the interior surfaces of the bag chamber 180 toward a vent 196 on a side of the fill tube 38.

Figure 5:
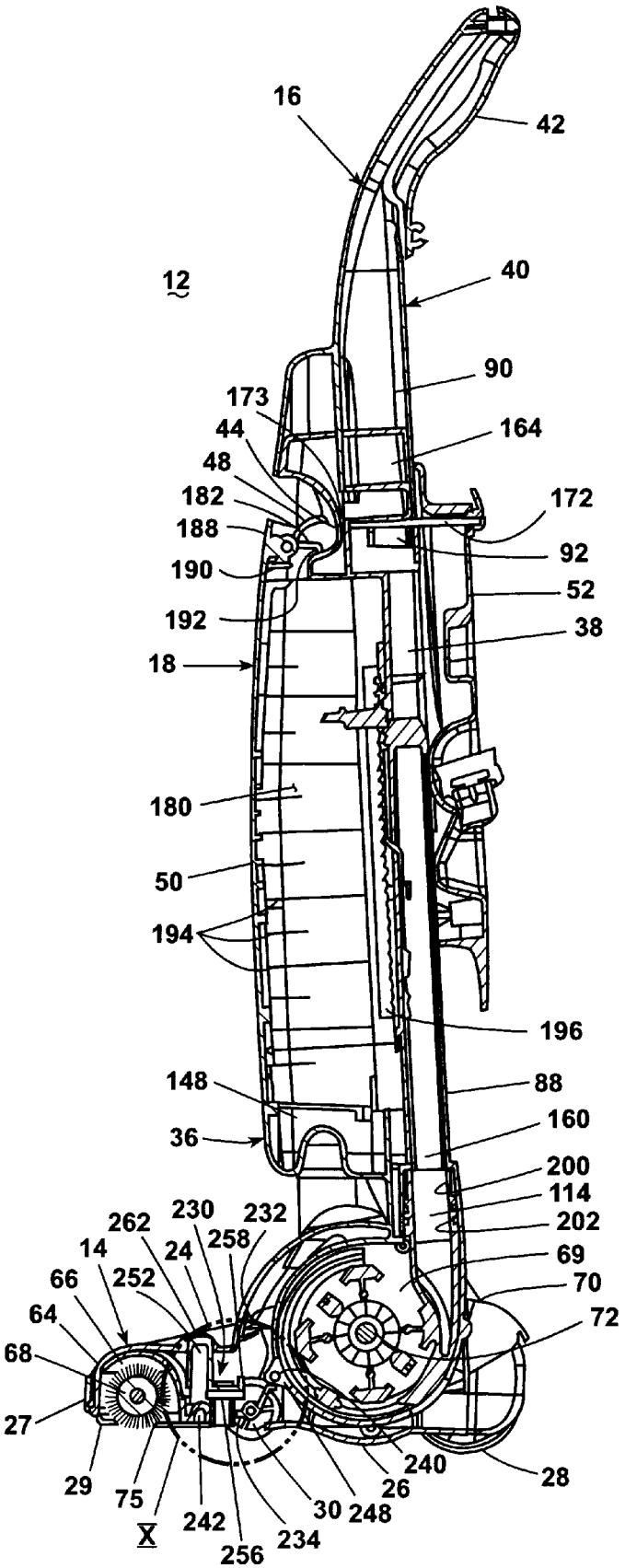
FIG. 5 is a cross-sectional view of the upright vacuum cleaner of FIGS. 1–4, taken along lines 5—5 of FIG. 3.
Figure 8:
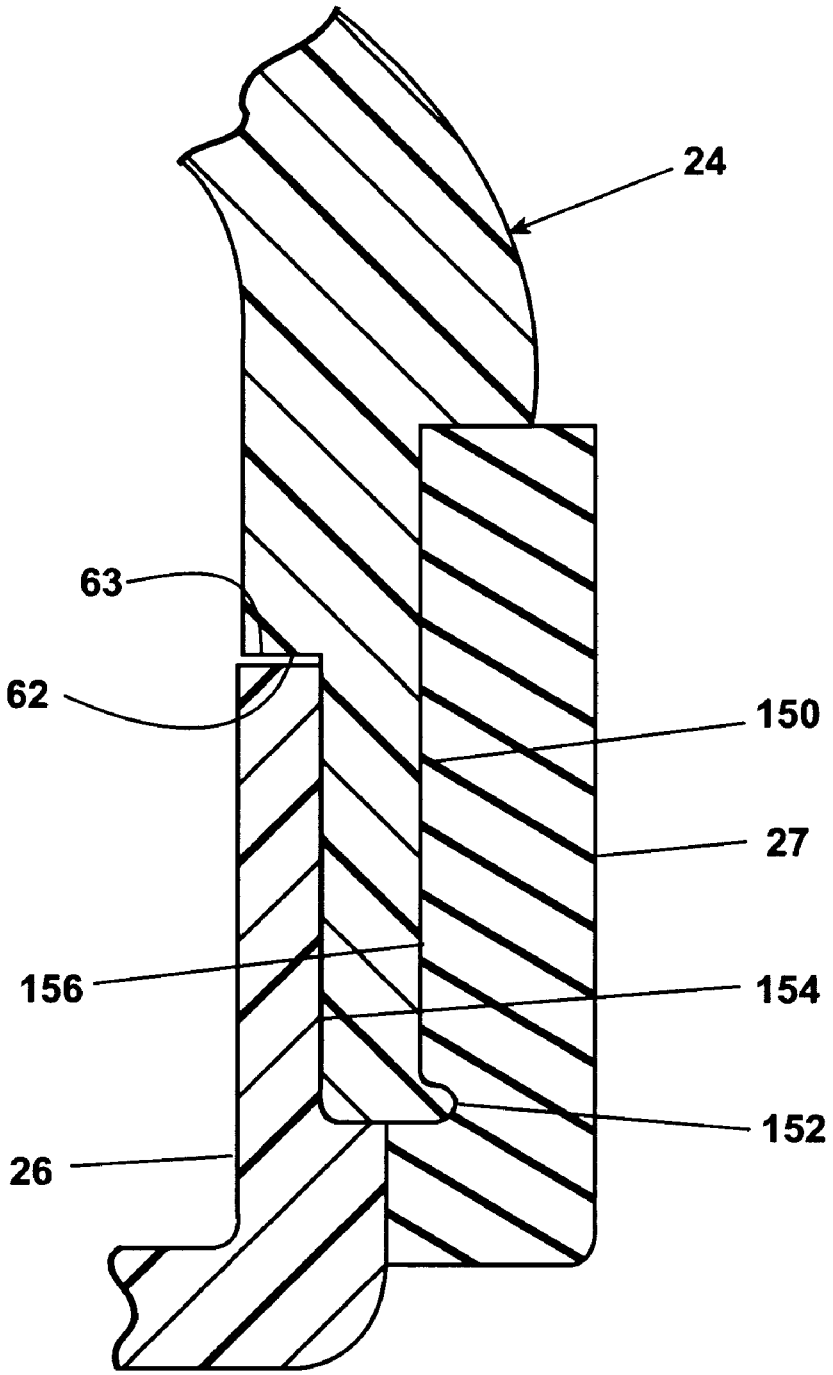
FIG. 8 is a fragmentary cross-sectional view of the vacuum cleaner of FIGS. 1–6, taken along lines 8—8 of FIG. 2.

Referring now to FIGS. 4 and 5, a vacuum motor 69 is provided inside a vacuum motor housing 70 which is rotatably mounted to the base pan 26. An upper surface of the vacuum motor housing 70 includes a pair of upwardly-extending rectangular flanges 71 and 73 disposed at a right angle with respect to each other and located adjacent a vacuum motor power toggle switch 218. A circular boss 108 extends from an impeller end 102 of the vacuum motor housing 70 and a second circular boss 146 extends from the other end of the vacuum motor housing 70. The boss 108 is inserted within an upwardly-extending circular retainer bracket 109 on the base pan 26 and the boss 146 is then urged downwardly and an end portion of the boss 146 is snapped into a slotted circular retainer bracket 147 extending upwardly from base pan 26. An inner portion of the boss 146, the circular bosses 108, 146 and retention brackets 109, 147 cooperate to pivotally secure the motor housing 70 to the base pan 26 as more fully disclosed in U.S. patent application Ser. No. 08/421,402 entitled Motor Mounting Arrangement and Method for a Vacuum Cleaner, filed Apr. 13, 1995, which is incorporated herein by reference. A downward-facing rib (not shown) on the cover 24 is positioned outwardly of the retainer bracket 147 to prevent the vacuum motor 69 from coming out of engagement with the retainer bracket 147 when the cover 24 is assembled onto the base pan 26.

As shown in FIGS. 4 and 5, an intermediate wall 64 of the base pan 26 forms a brush roll chamber 66 in which the brush roll 68 is rotatably mounted. A downwardly-facing brush roll opening 75 is provided in the brush roll chamber 66 for conventional on-the-floor cleaning. The brush roll 68 comprises a cylindrical body 130 having first and second bearings 132 and 133, respectively, at each end. Each bearing 132 and 133 includes an axially-extending projection 134 and 135, respectively. The cylindrical body 130 includes first and second axially-spaced transverse grooves 136 and 137 adjacent the second bearing 133 and has a crowned belt-receiving portion 138 between the grooves 136, 137. To assemble the brush roll 68 into the foot 14, a motor shaft 72 of the vacuum motor 69 extends from one end of the housing 70 and receives a brush roll belt 74. The belt 74 extends forwardly to capture the belt-receiving flange 138 of the brush roll 68 to rotatably drive the brush roll 68. The base pan 26 includes a first socket (not shown) into which the projection 134 on the bearing 132 is inserted. The projection 135 on the second bearing 133 is inserted into a vertical slot 140 in the base pan 26 and is retained therein by the bearing 148 on the sole plate 29 when the sole plate 29 is mounted to the base pan 26. The flanges 142 and 144 are semi-circular in configuration and form annular baffles in the drive belt 74. Similar semi-circular flanges are located on the base pan 26 in complementary relationship to the flanges 142 and 144. When the sole plate 29 is mounted to the base pan 26, the flanges 142 and 144 form annular baffles which are positioned in the first and second grooves 136 and 137 to prevent debris from entering the belt-receiving area 138. Preferably, the vacuum motor housing 70 and base pan 26 are designed such that the vacuum motor housing 70 rotates about the axis of rotation of the shaft 72 and the bosses 108, 146 are concentrically aligned with the axis of the shaft 72.

An impeller fan 110 is operably coupled to the motor 69 and is in the impeller end 102 of housing 70. The impeller fan 110 is received in a conventional volute chamber 112 of the vacuum motor housing 70. The volute chamber 112 terminates in an outlet conduit 114 which is integrally formed with the vacuum motor housing 70 and extends outwardly therefrom and is provided with a smooth upper portion 200 and a lower ribbed portion 202. A resilient motor output gasket 204 is fitted over the smooth upper portion 200 of the outlet conduit 114. The output gasket 204 comprises an elastomeric rectangular band having several raised horizontal ribs 206 disposed around its perimeter. The output gasket 204 is snugly inserted over the smooth portion 200 of the outlet conduit 114 and is further matingly received within the inlet tube 160 of the fill tube 38 in order to provide a sealed fit between the outlet conduit 1 14 of the vacuum motor housing 70 and the fill tube 38. The outlet conduit 114 of the vacuum motor housing 70 is then securely mounted to the base portion of the fill tube 38 by a conventional fastener 208 to permit the handle assembly 16 to rotate with the motor housing 70, with respect to the base pan 26 about the axis of rotation of the motor shaft 72.

Figure 2:
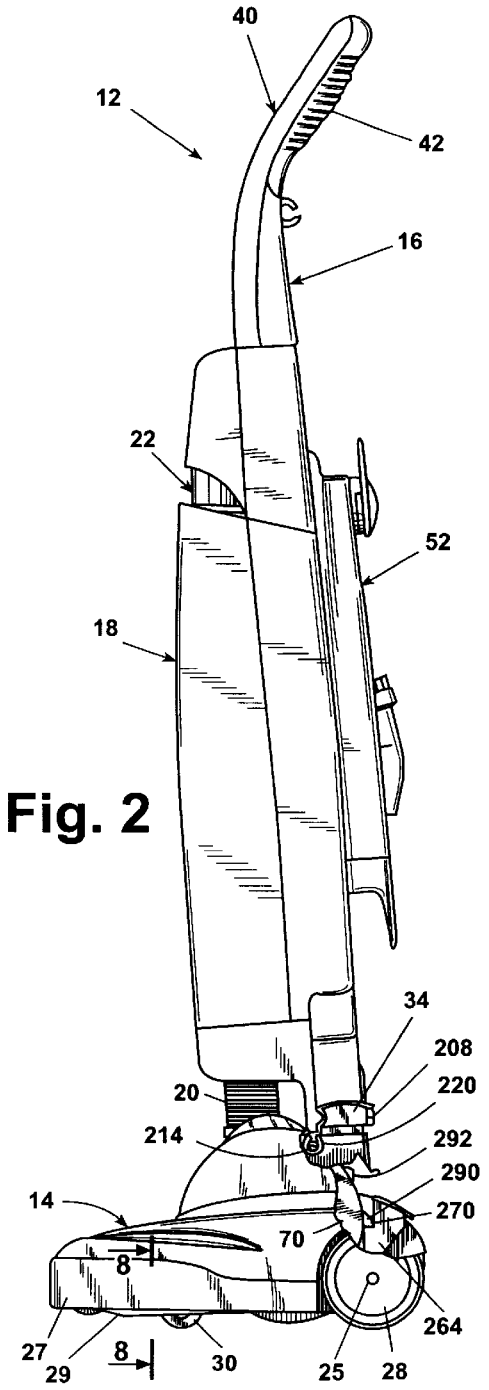
FIG. 2 is a side elevational view of the upright vacuum cleaner of FIG. 1.
Figure 3:
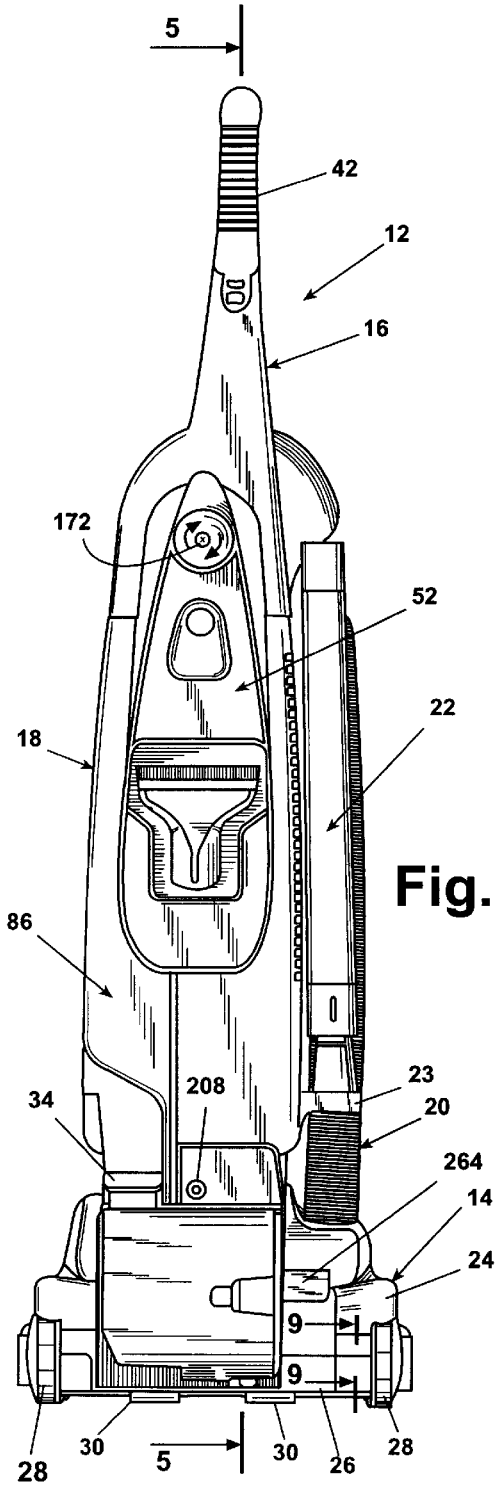
FIG. 3 is a rear elevational view of the upright vacuum cleaner of FIG. 1.

As shown in FIGS. 2, 4 and in greater detail in FIGS. 7A–7C, a foot pedal assembly 34 extends outwardly from the rear of the foot 14 and is adapted to be actuated by a user. The pedal assembly 34 abuts an actuator button 228 of a toggle switch 218 on the vacuum motor 69 to open and close the electrical circuit between the motor 69 and a conventional source of electricity supplied by the electrical cord 201.

The foot pedal assembly 34 comprises a foot pedal 210 pivotally mounted over a spring 212 on a mounting at a lower portion of the fill tube 38. The spring 212 is adapted to return the pedal 210 to a rest position after it has been depressed. It will be understood that the spring 212 is not a necessary element of this invention. The spring 212 can be removed so that any bias inherent in the toggle switch 218 returns the pedal 210 to the unbiased position.

The foot pedal 210 is defined by an upper wall 222 having a depending wall 224 located around the circumference thereof. The upper wall 222 can be provided with a specially-shaped configuration such as the ramped or sloped surface shown in FIGS. 7A–7C for ergonomic or aesthetic purposes. A rear portion of the upper wall 222 is provided with a rearwardly-extending flange 226 which has a pair of laterally-extending axle protrusions 214 thereon.

The protrusions 214 are shown in greater detail in FIG. 7C and have a pair of parallel flat side surfaces 225 connected by a pair of arcuate surfaces 227 at opposing ends thereof. The protrusions 214 pivotally mount to corresponding U-shaped sockets 220 located in a spaced relationship at a lower portion of the fill tube 38. The U-shaped sockets 220 generally comprise a pair of arcuate arms 221 which have upper ends disposed in a closely spaced relationship to the other. The spacing between the upper ends of the arm 221 is slightly greater than the distance between the side surfaces 225 so that the protrusions 214 can be slipped into the sockets 220 when the foot pedal is in the relationship illustrated in phantom lines in FIG. 7B. After the protrusions have been received in the sockets 220, the foot pedal can be rotated to the switch activating position illustrated in solid lines in FIG. 7B the foot pedal is thus journaled in the sockets 220 for activation of the switch 218 As shown in the enlarged perspective of FIGS. 7A–7C, the underside of the foot pedal 210 is also provided with an outwardly-extending flange 216 which generally comprises an X-shaped beam having a rounded end thereon. The flange 216 is extends from the underside of the pedal 210 so that the rounded end thereon abuts the toggle switch 218. As the pedal 210 is depressed, the flange 216 urges the toggle switch 218 downwardly as well. The spring 212 is inserted over the flange 216 when the foot pedal 210 is installed onto the fill tube 38 so that the spring 212 upwardly biases the flange 216 away from the toggle switch 218 to a rest position. After the pedal 210 is depressed, the spring 212 returns the pedal 210 to the rest position. Alternatively, the spring 212 can be eliminated so that the flange 216 rests on the toggle switch 218 so that the bias of the toggle switch 218 returns the foot pedal 210 to its original position after pressure on the pedal 210 is released.

To operate the vacuum cleaner motor 69, a user momentarily depresses the foot pedal 210 to force the flange 216 downwardly and depress the toggle switch 218. When the foot pedal 210 is urged downwardly a sufficient distance, the underside of the foot pedal 210 abuts the flanges 71 and 73 on the motor housing 70 which prevents overtravel of the pedal 210 with respect to the toggle switch 218 of the motor 69. In addition, the depending wall 224 and the flanges 71 and 73 cooperate to prevent debris from entering adjacent the vacuum motor 69. As the foot pedal 210 is released, the upward bias of either spring 212 or the toggle switch 218 returns the toggle switch 218 to its rest position. Electrical energy is then supplied to the motor 69. The toggle switch 218 is operated in a similar manner to cut off the electrical energy to the motor 69.

A working air conduit 76 is formed in the base pan 26 by a bottom wall 78 and a pair of upstanding side walls 80 and 82. It is closed on the top by a cover plate 84 which mounts a diverter valve 94. The diverter valve 94 is sealed to the side walls 80 and 82 and the bottom wall 78 by a shoulder (not shown) which is in contact with the side walls 80 and 82 during movement of the handle assembly 16 between an upright position and a reclining position. The working air conduit 76 extends rearwardly from one end of the brush roll chamber 66 to the impeller fan opening 110 to fluidly connect the brush roll chamber 66 to the impeller fan 110. A flexible hose mount 100 is integrally formed in the cover plate 82 and mounts the lower end of the flexible hose 20. The hose mount 100 is in registry with hose opening 98 in cover 24. Conventional fasteners such as adhesives can be used to secure the lower end of the hose 20 to the mount 100.

As shown in FIG. 4, the convertible upright vacuum cleaner 12 according to the invention incorporates a conversion valve assembly 120, described in U.S. patent application Ser. No. 08/511,715 filed on Aug. 4, 1995 and incorporated herein by reference, to selectively direct the suction generated by the impeller fan between either the brush roll chamber 68 or the flexible hose 20 depending upon the position of the handle 16 relative to the foot 14. The diverter valve 94 is controlled by the handle 16 to shut off the flow of air from the brush roll chamber 68 or the flexible hose in a manner described in Ser. No. 08/511,715. With the handle 16 received in the upright position as seen in FIG. 1, the diverter valve assembly 94 is pivoted to establish fluid flow communication between the flexible hose 20 and the volute chamber 112 and block fluid flow communication between the brush roll chamber 66 and the volute chamber 112. Therefore, all of the suction generated by the rotation of the impeller fan 110 is directed solely to the flexible hose 20 for above-the-floor cleaning when the handle assembly 16 is in the upright position as shown in FIG. 1.

Figure 10:
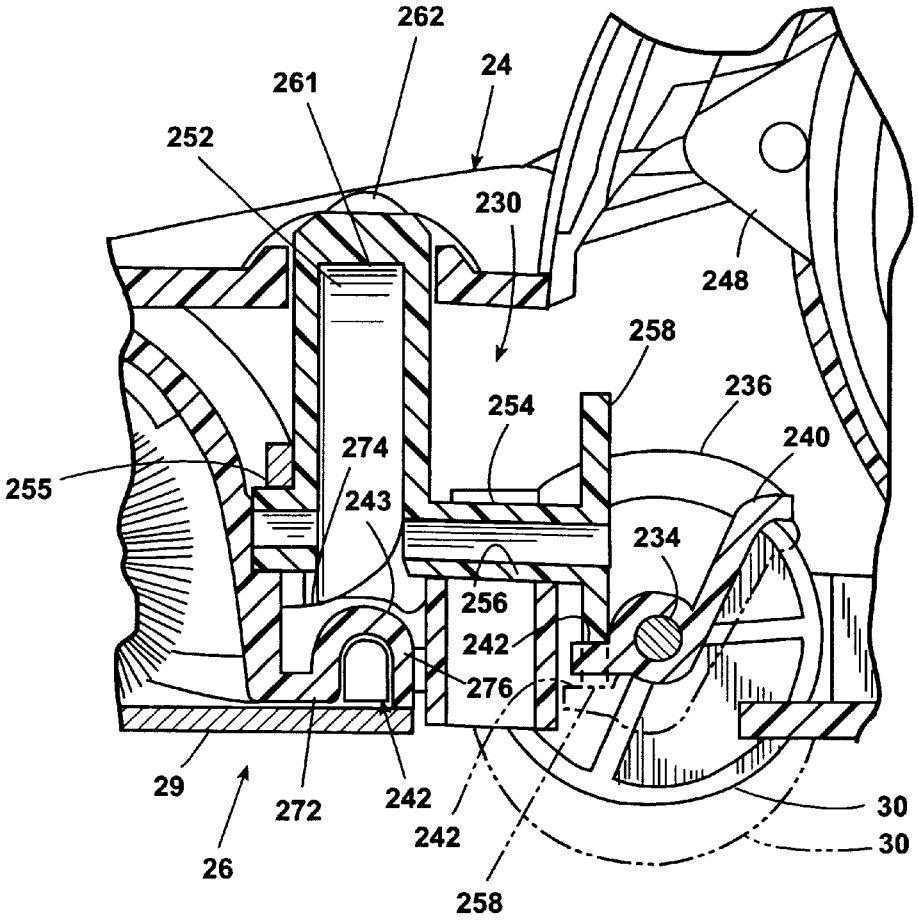
FIG. 10 shows cross-sectional view of the vacuum cleaner of FIGS. 1–6, enlarging the region marked 10 of FIG. 5.

The upright vacuum cleaner 12 also includes a lift assembly 230 which automatically lifts the brush roll chamber 66 from contact with the floor being cleaned when the handle assembly 16 is pivoted from an angular use position shown in FIG. 10 to the upright storage position shown in FIG. 1.

Turning to FIGS. 4, 5 and 10, the lift assembly 230 comprises a housing 232, axle 234 and lift wheels 30. The housing 232 comprises a pair of semi-cylindrical shells 236 and 238 connected at a central portion by a flange 240. The housing 232 includes two pairs of forwardly-extending flanges 242 each having a transversely-oriented cylindrical retainer bracket 243 extending upwardly therefrom. The base pan 26 includes two pairs of inverted U-shaped mounts 272 extending upwardly from the base pan 26 adjacent the brush roll chamber 66 and mounted to the base pan 26 at a forward leg 274 and a rearward leg 276. The housing 232 is assembled to the base pan 26 by positioning the housing 232 in a vertical orientation adjacent the U-shaped mounts 272. The housing 232 is then slid transversely in order to slidably insert the bracket 243 of the flanges 242 into the interior of the U-shaped mounts 272 for pivotable movement of the housing 232 in the U-shaped mounts 272. Axle 234 is mounted to the housing 232 and rotatably mounts the lift wheels 30, each of which is disposed within a shell 236 and 238 such that the housing 232 can pivot the attached lift wheels 30 downwardly through corresponding apertures 244 and 246 in a central portion of the base pan 26. The pivotably-mounted motor housing 70 includes an outwardly-extending triangular protrusion 248 along its forward surface. As the vacuum cleaner handle assembly 16 is rotated from a lower position to an upright position as shown in FIG. 1, the outwardly-extending protrusion 248 on the surface of the rotating motor housing 70 contacts the wheel housing 232 at central flange 240 and forces the wheel housing 70 to pivot downwardly with respect to the base pan 26 to thereby raise the forward end of the foot 14 with respect to the floor surface in order to prevent contact between the brush roll 68 and the floor surface.

Again turning to FIGS. 4, 5 and 10, the upright vacuum cleaner 12 also includes a manual height adjustment mechanism 250 comprising a thumb wheel 252 mounted at a central portion thereof to a forward end of a shaft 254 which is journaled at 256 in the base pan 26 and includes a smooth, elliptical eccentrically-mounted cam 258 at a rearward end of the shaft 254. The thumb wheel 252 comprises a substantially semi-cylindrical shell having several detents 260 on a forward surface and several rounded detents on an outward radial surface 261 thereof. The journal mounting 256 comprises a upwardly-extending slotted circular retainer. A central portion of the shaft 254 snap-fits within the journal mounting 256 which supports the shaft 254 for rotation about a longitudinal axis of the shaft 254. Alternatively, or in addition to the journal mounting 256, the forward end of the shaft 254 can be cantilevered within a circular socket 255 within the base pan 26 to provide additional rotational support for the shaft 254. At the opposite end of the shaft 254, the cam 258 bears against the central flange 240 of the wheel housing 232. The detents 260 along the outer forward surface of the thumb wheel 252 mate with a resilient deflectable finger (not shown) mounted to the base pan 26 to hold the thumb wheel 252 in one of several adjustment positions. In its assembled state within the base pan 26, the rounded detents on the outer radial surface of the thumb wheel 252 protrude through an aperture 262 on the cover 24 for access to the height adjustment mechanism 250 by the user. Although the thumb wheel 252 can be rotated while the handle assembly 16 is in the upright position, actual pivotable movement of the wheel housing can only occur when the handle assembly 16 is lowered into an angular use position. As shown in FIG. 10, when the handle assembly is lowered into an angular use position, the triangular protrusion 248 on the motor housing 70 is rotated upwardly above the housing 232. The weight of the vacuum cleaner rests in part on the lift wheels 30 urging them upwardly against the lower edge of the cam 258. As the height adjustment wheel 252 is rotated by the operator, the eccentric mounting of the cam 258 on the thumb wheel 252 moves the lower edge of the cam 258 vertically with respect to the base pan 26 which, in turn, urges the housing 232 upwardly or downwardly as shown in the phantom outline of FIG. 10. In addition, the rotation of the thumb wheel 252 positions the deflectable finger (not shown) at the next successive detent 260 on the forward surface of the thumb wheel 252 to retain the lift wheels 30 at the new height.

The upright or lowered position of the handle assembly 16 is controlled by a foot pedal 264 which locks the handle assembly 16 in an upright position, releases the handle assembly 16 for movement to a 45-degree position, and then further releases the handle assembly 16 to permit rotation of the handle to an essentially horizontal position. The foot pedal 264 is pivotably mounted to the base pan 26 of the vacuum cleaner 12 by an elliptical axle 266 similar to pivot mounts 214 and is adapted to be received by a slotted circular retainer (not shown) similar to C-shaped sockets 220 on the base pan 26. Foot pedal 264 includes an integral arm spring 268 mounted adjacent to an exterior side of the foot pedal 264 to bias the foot pedal 264 in an upright position. The motor housing 70, attached to the handle assembly 16 and rotatably mounted to the base pan 26, has first and second triangular protrusions 290 and 292 circumferentially disposed in a spaced relationship along a lateral radial portion of the motor housing 70 and which can register with a ridge 270 on the foot pedal 264. The first protrusion 290 is a "hard" detent comprising a substantially right triangular flange extending from a rearward portion of the motor housing 70 adjacent the impeller end 102 as shown in the cut-out portion of FIG. 2. The second protrusion 292 is a "soft" detent comprising a gently-sloped substantially isosceles triangular flange spaced circumferentially upward from the first protrusion 290. The first protrusion 290 retains the handle assembly 16 in a substantially vertical position, preferably about 5 degrees forward of vertical, and requires actuation of the foot pedal 264 to release the handle assembly 16 for rotation. The second protrusion 292 retains the handle assembly at approximately 45 degrees rearward of vertical and requires either actuation of the foot pedal 264 or slight manual downward pressure exerted on the nozzle 14 to release the handle assembly 16 for further downward rotation to a horizontal position. When the handle assembly 16 is to be rotated, foot pedal 264 is momentarily depressed which rotates it away from the motor housing 70 to release the ridge 270 on the foot pedal 264 from contact with the first protrusion 290 on the motor housing 70 to allow the handle assembly to freely rotate to a position defined by the second protrusion 292. The position of the protrusions 290 and 292 on the motor housing 70 are selected such that the handle position has three defined locations: a fully upright position approximately 5 degrees in front of vertical, an approximate 45-degree position used normally during operation of the vacuum and to lift the vacuum over a small obstruction and a horizontal position for vacuuming under tables. When the foot pedal 264 is released, the arm spring 268 urges the ridge 270 back into contact with the motor housing 70.

In operation, the handle assembly 16 on the upright vacuum cleaner 12 can be placed into a floor cleaning use position by actuating foot pedal 264 and lowering the handle assembly 16 into an approximate 45-degree position. The vacuum motor 69 can be actuated by momentarily depressing foot switch 34 allowing the vacuum cleaner 12 to be rolled over the floor surface to be cleaned. Depending upon the type of floor surface being cleaned, the thumb wheel 252 of the height adjustment mechanism 250 can be rotated clockwise or counterclockwise to raise or lower the housing 232 and, consequently, the foot 14 is repositioned at a particular desired height for optimal cleaning effectiveness. Once the foot switch 34 is actuated which supplies power to the motor 69, the brush roll 68 is rotated at a high speed through the transmission of the rotation of the motor shaft 72 through the belt 74. Dust and other debris is loosened by the brush roll 68 and suctioned into the working air conduit 76, expelled out of the outlet conduit 114, and into the vertical conduit in the fill tube 38 such that it is trapped in the filter bag 178 in the bag chamber 180. Alternatively, the hose 20 can be used to collect dust and debris when the handle assembly 16 is in the upright position as the conversion valve assembly 120 diverts the suction through the hose 20. When finished, the handle assembly 16 can be repositioned in the upright position as shown in FIG. 1 which automatically lifts the foot 14 from contact with the floor via lift mechanism 230 and turned off by again momentarily depressing foot switch 34.

On occasion, the vacuum motor drive belt 74 wears thin and requires replacement. When it is desired to replace the belt 74, the sole plate 29 can be removed, which exposes an axially-extending channel 280 in the base pan 26 into which extends the motor shaft 72 and the drive belt 74 which extends forwardly to its mounting to the brush roll 68. The sole plate 29 can be removed by manually disengaging each flexible finger 56 from engagement with the tabs 57 on the base pan 26 as discussed earlier in this application. The brush roll 68 is rotatably mounted within a brush roll chamber 66 within the base pan 26 and is retained at one end by a circular aperture in the base and at another end by a bearing projection on the sole plate 29. The sole plate 29 has a flexible finger 56 with a retainer which snaps into an opening in the base pan 26. The belt 74 passes around the shaft 72 of the motor 69 and around a groove on the brush roll 68 such that rotation of the shaft 72 causes the belt 74 to impart rotary motion upon the brush roll 68. The removal of the sole plate 29 from the base pan 26 reveals the wide channel 280 along the longitudinal path of the vacuum motor drive belt 74 such that the channel 280 provides easy access for removal and replacement of the drive belt 74. To replace the belt 74, the brush roll 68 is removed from the brush roll chamber 66 in the base pan 26 and a new belt can be slipped over the shaft 72 in the channel 280 and over the belt-receiving area 138 of the brush roll 68. The brush roll 68 can then be moved forward into the brush roll chamber 66 in the base pan 26 which stretches the belt 74 as it moves and provides the proper tension in the belt. The sole plate 29 is then remounted on the base pan 26 to retain the brush roll 68 and permit the rearwardly-extending flange on the sole plate 29 to re-cover the belt 74 in the channel 280.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

What is claimed is:

1. A vacuum cleaner comprising:

a housing;

a motor mounted in the housing;

a switch coupled the motor for actuating the motor to an operative and an inoperative condition, the switch includes an actuator button for moving the switch between an opened and a closed positions;

a foot pedal pivotally mounted to the housing and having a bottom surface in an abutting relationship with respect to the actuator button;

the improvement comprising:

the foot pedal including an axle having a pair of flat surfaces; and the housing has a slotted circular retainer including a gap between a pair of arcuate arms for mounting the axle and the axle flat surfaces are adapted to fit through the gap for mounting the axle to the circular retainer.

2. The vacuum cleaner of claim 1 wherein the axle of the foot pedal further comprises a pair of arcuate surfaces joining the flat surfaces and journals the axle within the slotted circular retainer.

3. The vacuum cleaner of claim 2 wherein the bottom surface of the foot pedal includes a depending flange in abutting relationship with the actuator button.

4. The vacuum cleaner of claim 3 wherein the depending flange of the foot pedal is x-shaped.

5. The vacuum cleaner of claim 4 and further comprising a spring disposed between the bottom surface of the foot pedal and the housing to bias the foot pedal away from the switch.

6. The vacuum cleaner of claim 5 wherein the spring at least partially surrounds the depending flange.

7. The vacuum cleaner of claim 6 wherein the spring at least partially surrounds the actuator button.

8. The vacuum cleaner of claim 1 wherein the bottom surface of the foot pedal includes a depending flange in abutting relationship with the actuator button.

9. The vacuum cleaner of claim 8 wherein the depending flange of the foot pedal is x-shaped.

10. The vacuum cleaner of claim 1 and further comprising a spring disposed between the bottom surface of the foot pedal and the housing to bias the foot pedal away from the switch, the spring at least partially surrounds a portion of the foot pedal and at least partially surrounds the actuator button.

11. The vacuum cleaner of claim 1 wherein the axle flat surfaces are substantially parallel to one another.

12. A vacuum cleaner comprising:

a housing;

a motor mounted in the housing;

a switch coupled the motor for actuating the motor to an operative and an inoperative condition, the switch includes an actuator button for moving the switch between an opened and a closed positions;

a foot pedal pivotally mounted to the housing and having a bottom surface in an abutting relationship with respect to the actuator button the improvement comprising:

the bottom surface of the foot pedal includes a depending flange in abutting relationship with the actuator button.

13. The vacuum cleaner of claim 12 wherein the depending flange of the foot pedal is x-shaped.

14. The vacuum cleaner of claim 13 wherein the bottom surface of the foot pedal includes a depending flange in abutting relationship with the actuator button.

15. The vacuum cleaner of claim 14 and further comprising a spring disposed between the bottom surface of the foot pedal and the housing to bias the foot pedal away from the switch.

16. The vacuum cleaner of claim 15 wherein the spring at least partially surrounds the depending flange.

17. The vacuum cleaner of claim 16 wherein the spring at least partially surrounds the actuator button.

18. The vacuum cleaner of claim 12 and further comprising a spring disposed between the bottom surface of the foot pedal and the housing to bias the foot pedal away from the switch, the spring at least partially surrounds a portion of the foot pedal and at least partially surrounds the actuator button.

19. A vacuum cleaner comprising:

a housing;

a motor mounted in the housing;

a switch coupled the motor for actuating the motor to an operative and an inoperative condition, the switch includes an actuator button for moving the switch between an opened and a closed positions;

a foot pedal pivotally mounted to the housing and having a bottom surface in an abutting relationship with respect to the actuator button the improvement comprising:

a spring disposed between the bottom surface of the foot pedal and the housing to bias the foot pedal away from the switch, the spring at least partially surrounds a portion of the foot pedal and at least partially surrounds the actuator button.

* * * * *